United States Patent [19]

Kunita et al.

[11] Patent Number: 4,852,480

[45] Date of Patent: Aug. 1, 1989

[54] DOT LINE PRINTER WITH INDIVIDUALLY REPLACEABLE PRINTING HEAD

[75] Inventors: Masao Kunita; Michio Koizumi; Seiichi Ohsawa, all of Saitama, Japan

[73] Assignee: Citizen Watch Co., Ltd., Tokyo, Japan

[21] Appl. No.: 294,993

[22] Filed: Jan. 6, 1989

Related U.S. Application Data

[63] Continuation of Ser. No. 159,501, Feb. 16, 1988, abandoned, which is a continuation of Ser. No. 935,145, Nov. 25, 1986, abandoned, which is a continuation of Ser. No. 770,393, Aug. 28, 1985, abandoned.

[30] Foreign Application Priority Data

Sep. 7, 1984 [JP] Japan ..... 59-187714

[51] Int. Cl.[4] ..... B41J 3/12

[52] U.S. Cl. ..... 101/93.05; 101/93.04; 101/93.29; 400/157.2

[58] Field of Search ..... 101/93.02, 93.04, 93.05, 101/93.29, 93.48; 400/121, 124, 157.2, 167, 719, 692

[56] References Cited

U.S. PATENT DOCUMENTS

| | | | |
|---|---|---|---|
| 3,967,714 | 7/1976 | Potma et al. | 101/93.05 |
| 4,218,149 | 8/1980 | Okada | 101/93.05 |
| 4,260,270 | 4/1981 | Cavallari | 101/93.05 |
| 4,306,497 | 12/1981 | Hamada | 401/93.05 |
| 4,448,553 | 5/1984 | Yonezawa et al. | 101/93.04 |
| 4,461,207 | 7/1984 | Helinski | 101/93.04 |
| 4,462,705 | 7/1984 | Hayashi et al. | 101/93.04 |
| 4,469,023 | 9/1984 | Hayashi | 101/93.04 |
| 4,509,421 | 4/1985 | Kurihara | 101/93.04 |
| 4,527,469 | 7/1985 | Wolf et al. | 101/93.04 |
| 4,602,881 | 7/1986 | Prevignano et al. | 101/93.05 |
| 4,625,638 | 12/1986 | Fritz et al. | 101/93.044 |

FOREIGN PATENT DOCUMENTS

| | | | |
|---|---|---|---|
| 148177 | 11/1980 | Japan | 400/124 TC |
| 194576 | 11/1983 | Japan | 400/124 TC |
| 136282 | 8/1984 | Japan | 400/124 |
| 2082508 | 3/1982 | United Kingdom | 400/124 TC |

*Primary Examiner*—David A. Wiecking
*Attorney, Agent, or Firm*—Koda and Androlia

[57] ABSTRACT

In printing heads for a dot line printer, a plurality of which are arranged in line on the reciprocal frame and impact printing wires toward a platen by the driving force of electromagnets excited with the basis of the printing commands, the printing heads for a dot line printer includes electromagnetic actuators including shells which contain and fix cores being wound driving coil around therein and base plates which are attached to the shells in order to close up their opening sides, and forming the tightly closed magnetic loops, and printing springs one ends of which are fixed and supported by supporting portions extended from the base plates, the top ends of which fix armatures at the postion facing to the cores. The printing heads can be unitized, and the close arrangement of the base plates and the armatures can be accomplished by means of direct positioning and fastening of the printing springs to the base plate so that the device can be obtained with excellent maintenance capability as well as small sizes and light weight.

2 Claims, 6 Drawing Sheets

DOT LINE PRINTER WITH INDIVIDUALLY REPLACEABLE PRINTING HEAD

This application is a continuation of Ser. No. 159,501, filed on Feb. 16, 1988 and now abandoned, which is a continuation of Ser. No. 935,145, filed on Nov. 25, 1986 and now abandoned, which is a continuation of Ser. No. 770,393, filed Aug. 28, 1985 and now abandoned.

BACKGROUND OF THE INVENTION

1. Field of the Invention

The present invention relates to printing heads for a dot line printer, and more particularly to complete assembly units of the printing heads in small sizes and light weight.

2. Description of the Prior Art

There has been a well-known dot line printer which can print characters, numerals and other symbols on printing paper by congregating a plurality of dots, and this dot line printer has been in wide use for the printer adopted in the data processing devices in the recent years, since all of the letters and the shapes can be optionally constructed by the combination of dots in this printer.

In order to increase the printing speed of the dot printer of this kind, it is required that the printing heads carrying printing wires move at a high speed to a line or a column direction with regard to a platen and printing paper, although such a moving speed is naturally limited by the response of magnetic actuators which drive the printing wires, and the other elements. In the prior art device, in order to enable the high speed printing, a plurality of printing wires were arranged in line with regard to the platen and driven in groups at the same time in accordance with the respective printing commands. This kind of printer is known as a dot line printer.

It is preferable in such a dot line printer to arrange in line the printing wires to provide all of the dots required to print one line. This arrangement requires such a wide space that the required number of the magnetic actuators cannot be actually positioned, and it is impossible to realize such a device cost effectively.

Because of this, such a device has been utilized that there are arranged in line the numbers of the printing wires corresponding to the dot positions of the numbers selected from all of the necessary dot numbers and that the frame wires carrying the printing wires are reciprocally driven only between the adjacent printing wire positions to provide false simultaneous printing. This device is known as a shuttle printer.

The shuttle type dot printer in the prior art is composed of the structure in which a plurality of printing wires and electromagnetic actuators are arranged in line and fixed to the shuttle frame, as is shown in the Japanese patent laying-open No. 59-131470 for example.

In this prior art device, such an improved dot line printer is provided that there is provided a permanent magnet to provide the urging force to the printing wire to make the light weight printing head is light in weight, which also makes the remarkably light in weight shuttle itself, and that also makes it not necessary to provide a balance weight for the shuttle drive.

In the prior art device mentioned above, however, the printing heads arranged in line on the shuttle frame are separated into the electromagnetic actuators and the printing springs which carry the printing wires respectively. As each of the electromagnetic actuator and the printing spring is separately fixed on the frame, each portion is still not lightened to the satisfactory degree and the printing heads have been limited their numbers to be attached to the shuttle frame. Thus, the high speed printing operation cannot be obtained by the device substantially small sized as practically requested.

Moreover, in the prior art device mentioned above, since the parts must be individually attached to the shuttle frame by screws or the like one by one and also must be individually adjusted at every assembling stage one after another, the efficiency in the assembly line is remarkably lowered. Especially, as the numbers of the printing wire to be assembled to the shuttle frame are increased, the unadjustment of only one printing wire prevents the other numbers of the printing wire block having no problem from proceeding to the next stage, and the efficiency is also extremely lowered in a practical production process.

Furthermore, in the prior art device, for the exchange of the worn-out printing wire, the inspection and the maintenance of the actuators, etc. every part must be individually maintained and a great deal of labor must be provided by skilled workers.

In order to solve such problems mentioned above it is preferable to unitize the printing head to be attached to the shuttle frame so that the adjustment in the assembly or the maintenance can be done by every unit, and such a kind of a device has been requested.

Conventionally, such unitization of the printing head was partially carried out unintentionally. Structurally, a dot printer having a single printing head is a fundamental example, and the movement of the printing head to column and line directions constructs requested dot letters by means of driving one or more printing wires at predetermined positions by the single printing head. In such a fundamental head conventionally offered therein is a unitized device of the electromagnetic actuator and the printing wire. However, in the shuttle type dot line printer such a device has never been provided that, when a plurality of printing wires are assembled to the shuttle frame, the individual printing head block is composed as a complete assembly unit; in other words, a unit completely unitized by both the electromagnetic actuator and the printing wire and perfectly adjusted as a complete assembly. Furthermore, this complete assembly unit is designed to be small in size and light in weight.

Especially, in the prior art device, such a thought has been predominant that the components of the respective printing heads are attached to a base plate being received by the shuttle frame. Even if each of the printing heads is unitized, every printing head is thought to have a separate base plate to attach the necessary component thereto. This base plate increases the weight of the printing head or the shuttle frame without question, which cannot be ignored. Accordingly, in the prior art device, despite troublesome adjustments and maintenances, it is a general thought that the shuttle frame receives the respective components as the base plate in order to have a light weight device, and there has been a tendency that every printing head avoids unitization.

Thus, in the prior art device, it was difficult to realize a dot line printer with higher production efficiency and low cost.

SUMMARY OF THE INVENTION

The primary object of the present invention is to provide an improved printer head for a dot line printer in which the efficiency in production and maintenance is far increased.

To achieve the object mentioned above, according to the present invention, there is provided a printing head for a dot line printer having a reciprocating frame in which the grooves are formed parallel to reciprocating direction of the frame and a plurality of actuating units mounted on the frame individually and releasably, each of the actuating units comprising a base plate formed of magnetically permeable material which serves to adjust the attracting gap between the armature and the core, a shell of square pole type having two edges secured to the side wall of the grooves of the shuttle frame and mounted on one side of the plate, a core secured to the shell, a coil wound around the core, a leaf spring one end portion of which is fixed on the other side of the plate, an armature fixed on the spring and at a position facing the core and a wire fixed on a free end of the spring, and each of the units being formed as a complete assembly unit in which the assembly and adjustment of these components have been finished before it is attached to the frame.

According to the present invention, there is provided a printing head for the dot line printer mentioned above wherein each of said actuating units further comprises a damper means for preventing a rebound of the spring.

According to the present invention, the support of the printing spring is formed by use of the base plate in the tightly closed type electromagnetic actuator mentioned above. To the printing spring mentioned above previously attached thereto are the printing wire and the armature, together with which the printing spring is directly fixed to the base plate mentioned above, and the relation to the positions between the base plate and the armature can be determined with extremely accuracy. Accordingly, it becomes possible to insert the armature into the closed magnetic loop of the tightly closed type magnetic actuator at the most efficient position, and a sufficiently large attracting force can be produced.

According to the present invention, furthermore, since the printing spring is received by a supporting portion extended from a part of the base plate which forms the tightly closed magnetic loop, a further base plate for printing spring is not necessary, even if it is a complete assembly unit, and the device can be easily designed in small sizes and light weight.

According to the present invention, moreover, since the printing head is obtained as a complete assembly unit after its position is adjusted, it is attached to the shuttle frame with extreme ease and the printer becomes advantageous in its easy maintenance and inspection, for example, by means of separate exchange of the printing head as a unit.

According to the present invention, excellent heat radiating characteristics for the printing head can be obtained and the attracting gap between the armature and the core can be easily adjusted.

DETAILED DESCRIPTION OF THE EMBODIMENT

Figure 1:
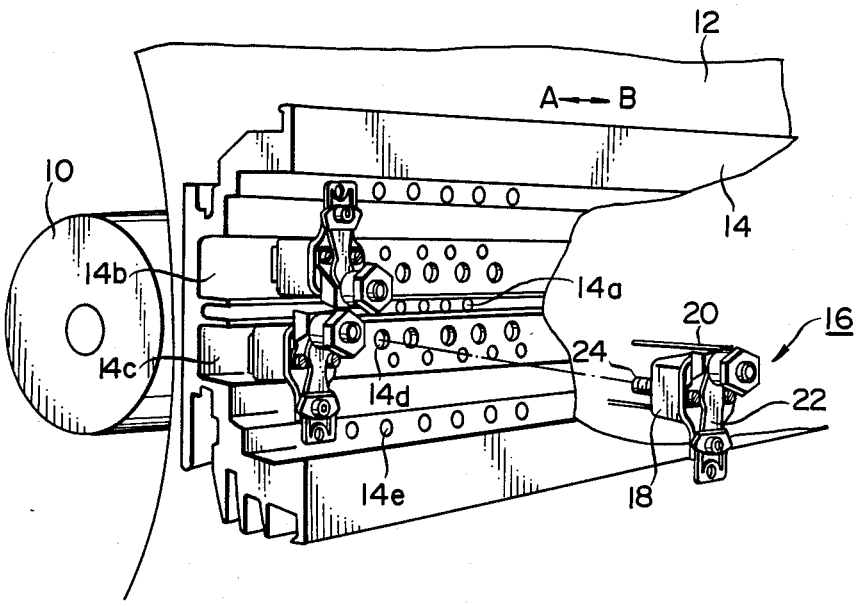
FIG. 1 is a schematic perspective view showing the state that a printing head in accordance with the teachings of the present invention is assembled to a shuttle type dot line printer.

FIG. 1 shows a total schematic view of a shuttle type dot line printer applying printing heads therein in accordance with the teachings of the present invention. A platen 10 windingly holds printing paper 12 and a shuttle frame 14 is supported to be reciprocally driven to the directions of arrows A and B along the platen 10 and the printing paper 12 so that the dotted letters can be formed on the printing paper 12 during the reciprocal movement of the shuttle frame 14. It is preferred that this shuttle frame itself can be made of light weight material, for example, aluminum. The shuttle frame itself also works as a heat radiator which efficiently discharges heat from the respective printing heads.

Along the center line part of the shuttle frame 14 mentioned above provided therein are wire penetrating holes **14*a* which printing wires project through. On the upper and the lower sides of the center line part also provided thereon are two grooves 14*b* and 14*c* to which the printing heads in complete assembly units 16 are firmly fixed thereto in an inverted position and these grooves 14*b* and 14*c*** make the heat generated by the coil located in the shell radiate outwardly since they are fixed to the outer wall of the shell. This will be described in detail later.

The complete assembly units 16 unitedly has printing springs 22 which carry the printing wires 20. In this state in the complete assembly units 16 the respective components are assembled up and positionally adjusted perfectly.

Figure 2:
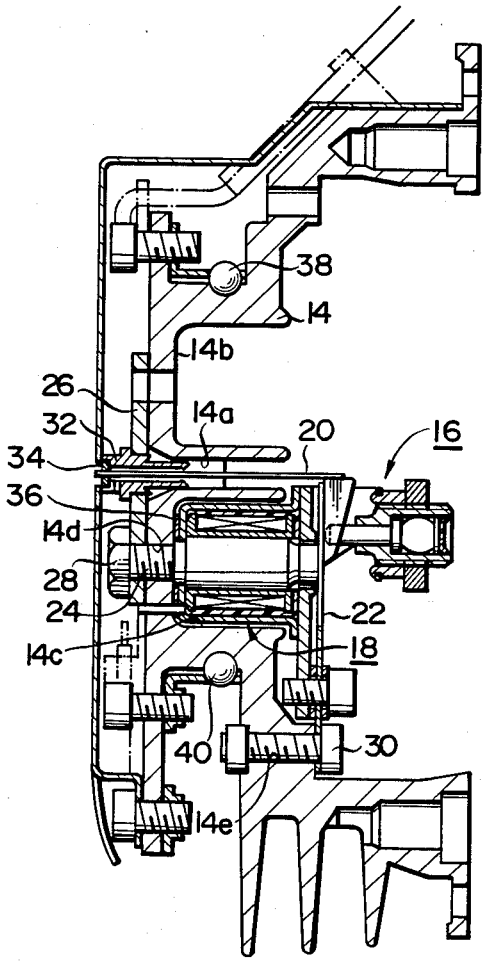
FIG. 2 is a sectional view of a principal portion of the assembled state of FIG. 1.

In FIG. 2 shown therein is a state that the complete assembly unit 16 is fixingly held by the shuttle frame 14. The complete assembly unit 16 is firmly fixed to the shuttle frame 14 by screw 24 projected from one end of electromagnetic actuator 18 through a penetrating hole **14*d* of the shuttle frame 14 and sandwiched wire guide plate 26 with the fixing nut 28**.

The tail end of the printing spring 22 is fastened through the penetrating hole **14*e* of the shuttle frame 14 by a screw 30. Thus, the complete assembly unit 16 is firmly attached to the shuttle frame 14** in a state that a rotary movement is prevented.

To the wire guide plate 26 fixed thereon is a washer 32 engaging with a wire penetrating hole **14*a* of the shuttle frame 14 by means of caulking, and a wire bearing 34 is fixed to the washer 32. The printing wire 20 is positioned at the right place by the wire bearing 34, and is reciprocally moved toward the printing paper 12 by the electromagnetic actuator 18 so that the printing wire 20 is slidably supported by the bearing 34**.

As described hereinafter, the complete assembly unit 16 itself is assembled and adjusted perfectly and positionally as the printing head, but it is preferred to insert a spacer 36 having an adequate thickness between the electromagnetic actuator 18 and the fixing groove 14*c* (14*b*) of the shuttle frame 14 in order to correctly adjust the tip end position of the printing wire 20 at the state that the complete assembly unit 16 is attached to the shuttle frame 14 so that the final position of the printing wire 20 can be determined.

The shuttle frame 14 efficiently radiates the heat of the complete assembly unit 16, a plurality of which are arranged in line thereon, and a temperature sensor composed of thermister 38 and 40 on the upper and lower side of the frame 14 with at least one on either side, is provided in order to detect the temperature of the frame 14, and can provide control so that excessive electric current does not flow over through the respective electromagnetic coils.

Figure 3:
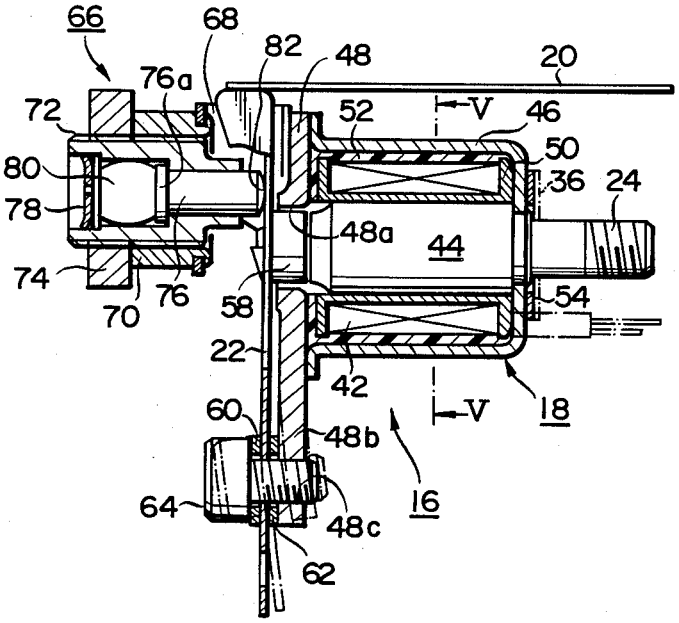
FIG. 3 is a sectional view of a principal portion showing a preferred embodiment of the printing head in accordance with the teachings of the present invention.
Figure 4:
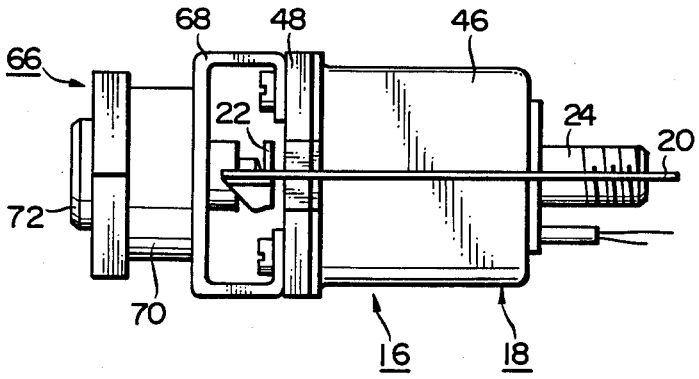
FIG. 4 is a plan view showing a principal portion of FIG. 3.
Figure 5:
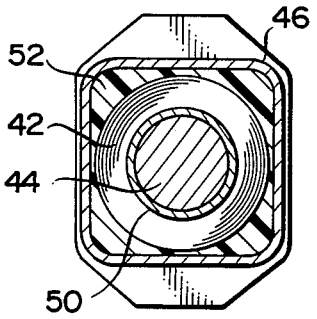
FIG. 5 is a sectional view of an electromagnetic actuator taken on line V—V in FIG. 3.

FIGS. 3, 4 and 5 show a structure of the printing head complete assembly unit 16 in details.

In the present invention, in order to design the device to be in smaller sizes and increase drivability of the printing wire 20, as the electromagnetic actuator 18 is formed as a tightly closed magnetic loop type electromagnetic actuator, a core 44 with a coil 42 is wound around is sealed into a space in a shell 46 in a state sealed by the shell 46 and a base plate 48. The base plate 48 is formed of magnetically permeable material for acting as a yoke for the electromagnetic actuator.

The fixing screw 24 mentioned above is unitedly formed with the core 44 and the coil 42 is mounted on the core 44 at the state that the coil 42 is wound around a bobbin 50.

The shell 46 formed of magnetically permeable material in the embodiment has a cross-sectional shape of a square as is shown in FIG. 5, and is formed by reduction deformation process. As shown in FIG. 1, the shell 46 having the square cross-section can establish a large zone of contact between the shuttle frame 14 and its outer surface, when it is fixed to the groove 14*b* (14*c*) of the shuttle frame 14, and the heat transfer from the electromagnetic actuator 18 to the shuttle frame 14 can be quickly carried out. Furthermore, as shown in FIG. 5, the square shaped shell 42 makes unnecessary space between the coil 42 contained therein and the inside of the shell 42, but; in the embodiment, such space is filled with a filler 52 consisting of epoxy resin having high heat transfer characteristics, which rapidly transfers the heat generated in the coil 42 through the shell 46 transferring further to the shuttle frame 14, as is mentioned above. It is preferable that the filler with high heat transfer characteristics as is mentioned above is also filled in the zone of contact between the shell 46 and the shuttle frame 14.

On the outside of the bottom surface of the shell 46 is fixed a spacer ring 54 by cementing or welding, one side of which protects from projection by caulking portion which fixes a core 44 to the shell at the foot of the screw 24, and the complete assembly unit 16 can be firmly fixed at a correct position in a groove of the shuttle frame 14 by use of the other plane surface side of the spacer ring 54. The spacer 36 is also provided in the groove between the space ring 54 and the shuttle frame 14 when necessary.

The end face of the core 44 mentioned above forms a contact area to an armature, which will be hereinafter described about, being provided on the printing spring 22 and extremely important for the reference plane of the electromagnetic actuator 18. According to the present invention, it is also important to establish a correct positional relation between the open end of the shell 46 and the end face of the core 44 since the shell 46 and the base plate 48 from the tightly closed magnetic loop and the base plate 48 becomes the fixing base of the printing spring 22 carrying the armature.

Figure 6:
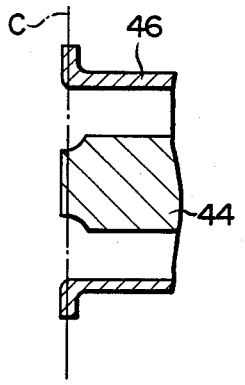
FIGS. 6 and 7 are illustrations describing forming steps of a core in the embodiment.
Figure 7:
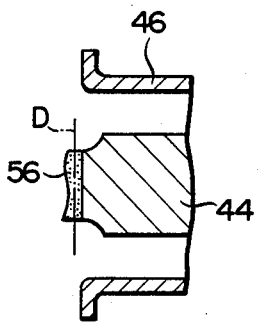

In the embodiment, after the core 44 is caulked and fixed to the shell 46, both of them are adjusted positonally, as is shown in FIGS. 6 and 7.

First of all, as shown in FIG. 6, after the core 44 is fixed to the shell 46, the opening end of the shell 46 and the end face of the core 44 are ground at the same time, as is shown by a working line C, to make relatively the same plane.

Furthermore, in the embodiment, after the same plane processing mentioned above, the end base of the core 44 is formed a super hard face layer 56 by means of injecting super hard particles as is shown in FIG. 7. The super hard face layer 56 is useful for reducing the defacement of the contact area with the armature 58, which will be hereinafter described. Since the super hard face layer 56 has a rough surface in the projected state, the end face of the super hard face layer 56 is again ground to finish along the working line D, as is shown in FIG. 7, so that the end face of the super hard face layer 56 can be finished with an accurate position with regard to the opening end of the shell 46.

The present invention is characterized in that the base plate 48 forming the tightly closed magnetic loop type electromagnetic actuator 18 provides the supporting portion fixing the printing spring 22. This base plate 48 is welded and fixed to the shell 46, the open end of which is correctly ground. Accordingly, electromagnetic actuator 18 forms the tightly closed magnetic loop through the core 44, the shell 46 and the base plate 48, and correctly positioned so that the armature 58 fixed to the printing spring 22 can be accurately cleared through an opening 48*a* provided in the base plate 48. Thus, the armature 58 forms a part of the tightly closed magnetic loop of the electromagnetic actuator to be provided the magnetic attractive driving force with extreme high efficiency.

As shown in FIG. 3, the base plate 48 is slightly bent outside on the edge of the opening 48*a*, which is useful for the magnetic flux to flow into the armature 58 without leaking to the core 44 side. In order to bend outside the edge of the opening 48*a*, for example a press stamping from the right side in FIG. 3 and a boring finish of the inner circumference can easily make the edge of the opening 48*a* of the base plate 48.

The base plate 48 mentioned above has a supporting portion 48*b* extended toward the lower side in FIG. 3. A screw hole 48*c* provided at the lower end of the supporting portion 48*b* becomes the standard position to support the printing spring 22. In other words, sandwiched by spacers 60 and 62, the printing spring 22 is firmly fixed to the supporting portion 48*b* of the base plate 48 at its one end by a screw 64.

Accordingly, the printing spring 22 can be directly fixed to the base plate 48, and the positional relation between them can be established with high accuracy. Consequently, since the armature 58 can be arranged with extremely close relation to the opening 48*a* of the base plate 48, the magnetic gap between the base plate 48 and the armature 58 can be established to be the minimum and the magnetic efficiency can be remarkably increased.

As is well known, when the electromagnetic actuator 18 is excited by a printing command, the printing spring 22 is attracted until the armature 58 makes contact with the core 44, and the printing wire 20 can be driven to correctly impact toward the printing paper 12. At this time, in order to have the large magnetic drive force, to determine the correct dot position, and to decrease the friction between the core 44 and the armature 58, it is necessary for the core 44 and the armature 58 to make plane contact with each other at the time of their contact. Slanted contact at this time causes in incorrect dot position, decreases attracting force and increases friction generated from a concentrated load to a part of the contact zone, etc., and the defacement at this point is remarkably increased.

Here, in the embodiment, in order to make the plane contact between the core 44 and the armature 58 the supporting portion of the base plate 48 mentioned above is provided with a predetermined bend.

Figure 8:
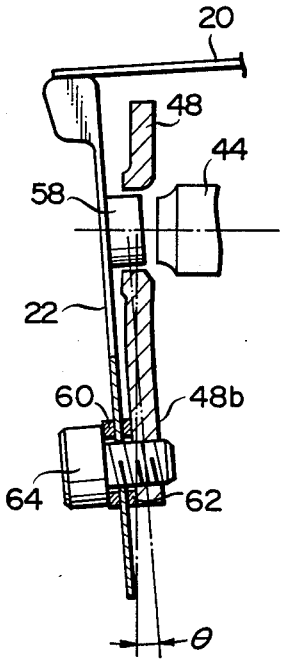
FIGS. 8 and 9 are illustrations describing a bending action of a portion extended from a base plate to support a printing spring in the embodiment.
Figure 9:
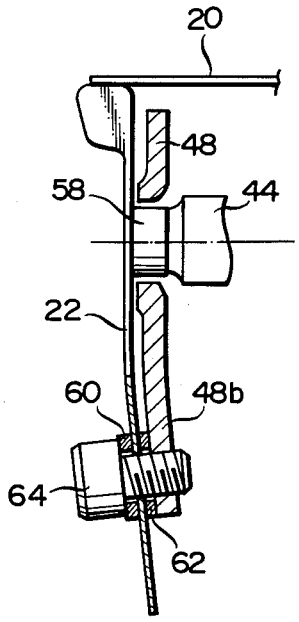

In other words, when the printing spring 22 is arranged in parallel to the base plate 48, as is shown by solid lines in FIG. 3, the printing spring 22 is bent by the attracting drive of the armature 58 so much that the core 44 inevitably makes slanting contact with the armature 58, which becomes the unfavorable result as previously described above. Accordingly, in the embodiment, the supporting portion **48*b* of the base plate 48 is slightly bent to the counter-clockwise direction, as is shown by chained lines in FIG. 3 (exaggerated). As shown in FIG. 8 as a model, the printing spring 22 is provided a printing bias angle $\theta$. Thus, as shown in FIG. 9, in such a state that the printing command to the electromagnetic actuator 18 attracts the armature 58 to the core 44**, both of them makes plane contact, and the defective slant contact can be eliminated.

In order to provide the printing bias angle $\theta$ to the supporting portion **48*b*, the bending work is done by means of non-elastically deforming the supporting portion 48*b* while measuring the position of the printing spring 22 or the armature 58 in the state of the complete assembly unit 16 being fixed in a jig, and the use of a spacer, a shim or the like cannot allow the device to be designed to be in light weight as well as to be easily assembled. It should be understood that the establishment of the printing bias angle of the printing spring 22 in the bending work can be obtained in the present invention from the fact that the supporting portion 48*b* is extended from the base plate 48 of the electromagnetic actuator 18 to support the printing spring 22** thereon.

In the embodiment, since the armature 58 is unitedly fixed to the printing spring 22 by means of caulking for example, and the printing wire 20 is brazed on the top end of the printing spring 22, the complete assembly unit 16 can be obtained in such a state that the printing spring 22 is fixed to the base plate 48 of the electromagnetic actuator 18.

Figure 11:
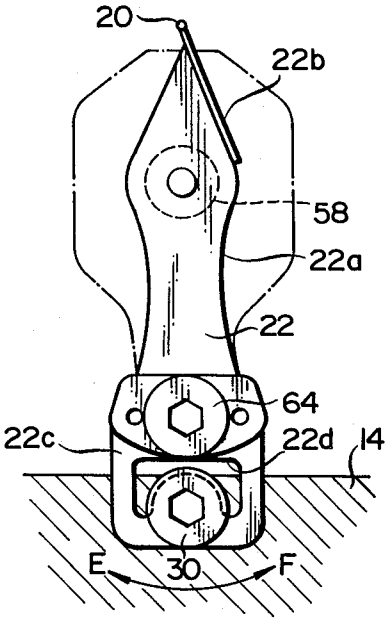
FIG. 11 is a sectional view of FIG. 10.
Figure 10:
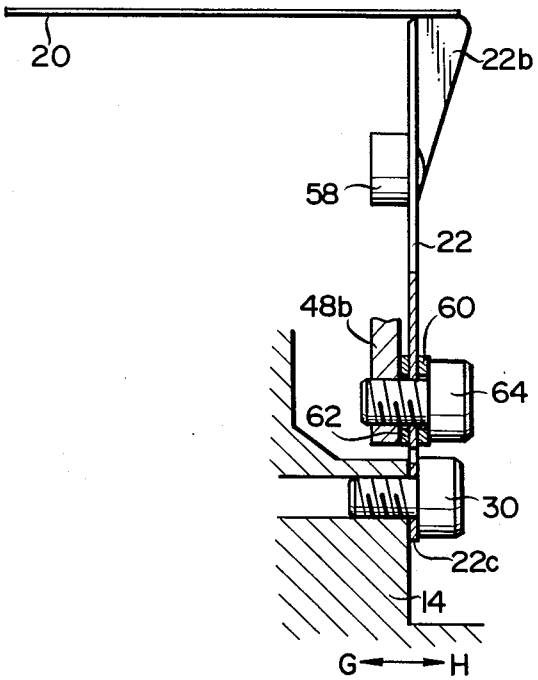
FIG. 10 is a sectional view of a principal portion showing an attaching state of the printing spring.

In FIGS. 10 and 11 shown therein are the structure of the printing spring 22 and the structure for attaching its end to the shuttle frame 14. The printing spring 22 is supported and fixed to the supporting portion **48*b* of the base plate 48 by the screw 64 on its one side, and the narrow portion 22*a* is provided between the supported position and the armature 58, as is shown in FIG. 11. The printing spring 22 is bent mainly at this narrow portion 22*a*. A bend 22*b* is provided on the top end (the upper end in FIGS. 10 and 11) of the printing spring 22, and the printing wire 20 is brazed on the top end of this bend 22*b*. As shown in FIG. 2, the whirl stop supporter 22*c* is provided on the lower end of the printing spring 22 to be fixed to the shuttle frame 14 by the screw 40 and is formed an opening 22*d* so that the whirl stop can firmly stop rotating in the directions of arrows E and F in FIG. 11 and the movement to the directions G and H in FIG. 10 can be preferably absorbed. Thus, the changes to the axis directions can be absorbed by the whirl stop supporter 22*c*, when the complete assembly unit 16 is fixed to the shuttle frame 14**.

In the embodiment, a damper 66 is provided to the printing spring 22 for preventing a rebound of the spring 22 at the time of its return from impacting and this damper 66 is also directly fixed to the base plate 48. The complete assembly unit 16 can be obtained in the state including the damper 66.

In FIGS. 3 and 4, the damper 66 is directly screwed and fixed to the base plate 48 by a bridge shaped blank 68 to which a holder 70 is attached, and a damper guide 72 is threadlikely coupled with the holder 70. The threadlike coupling of a nut 74 to the damper guide 72 enables the damper guide 72 to be optionally positioned and fixed along its axis direction.

The damper guide 72 mentioned above slidingly supports a spring receiving shaft 76 in the direction of its axis. The damper function can be effected by the spring receiving shaft 76 and an elastic body 80 which is provided between a stopper plate 78 and a flange **76*a* of the spring receiving shaft 76**.

In the embodiment, on the top end of the spring receiving shaft 76 fixed thereon is a rubber plate 82 as a shock absorber so that the direct shock of the printing spring 22 with the spring receiving shaft 76 can be avoided to reduce the friction at this contact portion.

In this embodiment, the total mass of the printing spring 22 and its accessories is established to match with the total mass of the spring receiving shaft 76 and the elastic body 80 which are provided in the damper 66. Accordingly, the energy when the printing spring 22 returns, is firmly absorbed by the damper 66, and to the damper 66 the printing spring 22 discharges the energy retained therein at the returned position so that it can stop at this position instantly. The damper 66 receives the energy retained in the printing spring 22 at the time of its returning as the retrogradely moving energy of the spring receiving shaft 76 and the absorption of this energy as internal friction force of the elastic body 80 creates the firm standstill action of the printing spring 22.

Accordingly, the establishment of such damper 66 as mentioned above increases the response of the complete assembly unit 16 remarkably and enables high speed printing.

As mentioned hereinabove, according to this embodiment, all of the electromagnetic actuator 18, the printing spring 22 and the damper 66 can be assembled in the complete assembly unit 16, and the base plate 48 of the electromagnetic actuator 18 supports and couples with such components as a common base plate. Thus, all of the parts can finish their installations and positional adjustments as a complete assembly unit before it is fixed to the shuttle frame, etc., despite their small size and light weight, and a device can be obtained with excellent productivity and maintenance.

Especially, in case of the device using the tightly closed magnetic loop type electromagnetic actuator, the effective use of its yoke as a common base plate of the various parts can provide a device of small in size and low cost with excellent magnetic converting efficiency.

As described heretofore, according to the present invention, it becomes possible to separately produce the printing head as the complete assembly unit, to finish the positional adjustment and the other fine adjustment of the parts at every printing head complete assembly unit, to complete the assembly of the shuttle type dot line printer only by means of attaching the respective complete assembly units to the shuttle frame, when assembling the printer, and to judge the individual quality of the respective complete assembly units at the time in the maintenance of the device, or exchange as a unit by the simple detachable action. Thus, the device can be obtained with excellent maintenance capability.

Furthermore, according to the present invention, the use of the tightly closed magnetic loop type electromagnetic actuator and its yoke as the common base plate of the components provides an actuator which is small size and light in weight in the shuttle frame area, which largely contributes to the design of a dot line printer which is totally smaller and to simplify the device. In addition, with the actuators and design of the present invention heat radiation can be quickly carried out and the attractive gap between the armature and the core can be adjusted with high accuracy.

What is claimed is:

1. A printing head for a shuttle type dot line printer including a single reciprocating frame and a plurality of electromagnetic actuating units individually mounted on the frame, said single reciprocating frame being made of a material of high heat conductivity such as aluminum, being provided with rectangular-bottomed recesses formed parallel to a platen for closely accommodating said plurality of electromagnetic actuating units and being provided with heat radiation fins formed parallel to said platen for radiating heat generated by said units, and each of said electromagnetic actuating units comprising:

a base plate formed of electromagnetically permeable material;

a shell mounted on one side of the base plate, said shell being of a square cross section capable of fitting into said rectangular recess in the frame and occupying said recess with identical other shells arranged closely side by side, and said shell having an open end;

a core secured to the shell with an end of said core lying in the same plane as said open end of said shell;

a coil wound around the core;

a heat conductive filler provided in said shell between said coil and inner surface of said shell, said heat conductive filler consisting of high heat conductive epoxy resin filler which is provided between said coil and said square cross sectional shell for radiating heat generated in said coil to said shell with high efficiency;

a single printing spring, one end of which is fixed on the other side of said base plate;

an armature fixed on the spring and at a position facing the core, said armature being attracted to said core when said coil is energized;

a wire carried on a free end of the printing spring;

a single screw extending from a backside of said shell and a single screw extending only through said one end of said printing spring, whereby each of said electromagnetic actuating units is individually, removably mounted to said frame by only both said single screws; and a damper means for preventing a rebound of said printing spring affixed to said base plate adjacent to said free end of said printing spring.

2. The printing head for a dot line printer according to claim 1 wherein said base plate is slightly bent in a vicinity of an end portion fixing said spring, and the surface of said spring is kept at an inclination angle to the end surface of said core so that the opposing surfaces of said armature and said core make plane contact at the time of their contact.

* * * * *